US005409135A

United States Patent [19]

Campau

[11] Patent Number: 5,409,135

[45] Date of Patent: Apr. 25, 1995

[54] LIQUID DISPENSING APPARATUS

[75] Inventor: Daniel N. Campau, Grand Rapids, Mich.

[73] Assignee: Flow Rite Controls, Ltd., Grand Rapids, Mich.

[21] Appl. No.: 833,831

[22] Filed: Feb. 18, 1992

[51] Int. Cl.[6] ..... B67B 7/00

[52] U.S. Cl. ..... 222/1; 222/484; 222/534

[58] Field of Search ..... 222/420, 484, 212, 107, 222/135, 1, 534; 4/227.5, 227.1; 43/1

[56] References Cited

U.S. PATENT DOCUMENTS

| | | | |
|---|---|---|---|
| 3,864,763 | 2/1975 | Spransy | 222/420 X |
| 4,519,529 | 5/1985 | Seltz | 222/484 |
| 4,732,303 | 3/1988 | Wang | 222/484 |
| 5,119,975 | 6/1992 | Jemielita | 222/420 |
| 5,125,544 | 6/1992 | Millner et al. | 222/420 X |

*Primary Examiner*—Gregory L. Huson
*Attorney, Agent, or Firm*—Niro, Scavone, Haller & Niro

[57] ABSTRACT

An automatic microflow dispensing apparatus for dispensing small amounts of liquid at discrete time intervals, including a container for holding the liquid, and a dispensing element positioned on the container below the liquid level when the container is oriented to dispense the liquid. The dispensing element includes an air intake port and a liquid discharge port positioned below the air intake port when the container is oriented to dispense the liquid. These two ports are each in fluid communication with the container liquid. The vertical distance between the air intake port and the liquid discharge port defines a head which remains substantially constant during dispensing. The air intake port has a vertical height relative to the head sufficient to provide a predetermined microflow of the liquid.

12 Claims, 1 Drawing Sheet

LIQUID DISPENSING APPARATUS

BACKGROUND OF THE INVENTION

The present invention is directed generally to a liquid dispensing apparatus and, more particularly, to a device which dispenses a liquid at a relatively low and generally constant rate of flow with no external controls or adjustment.

There are a variety of applications which require some form of device or apparatus that dispenses a liquid at low and generally constant flow rates. Examples of such applications include chemical processes, plant watering and fertilization systems, laboratory titration systems and the like. One particularly desirable use of such a dispensing apparatus is in the slow, timed release of an animal attractant, such as a liquid deer attractant. However, there is no known device suitable for such applications which is inexpensive, reliable and easy to use and which does not depend on auxiliary or external controls.

SUMMARY OF THE INVENTION

The present invention is directed to a novel and unique dispensing apparatus which is able to dispense a wide variety of liquids at a relatively low and generally constant flow rate over a prolonged period of time without external controls.

The liquid dispensing apparatus of the present invention includes a container adapted to hold a liquid, thereby defining a liquid level within the container, together with a dispensing nozzle which is positioned on the container below the liquid level. The dispensing nozzle includes a liquid discharge conduit and an air intake passageway. The liquid discharge conduit terminates at its lower-most end with a liquid discharge port in fluid communication with the liquid in the container. The air intake passageway, in turn, terminates at its upper-most end in an air intake port which is also in fluid communication with the liquid in the container. The liquid discharge port is positioned below the air intake port, and each of these ports has a size and relative location, one to the other, such that the liquid is dispensed from the container as discrete droplets which form and separate from the container at a slow and relatively constant rate that is independent from the liquid level in the container.

In accordance with a particularly preferred embodiment of the present invention, the liquid dispensing nozzle is of the so-called "flip-top" variety in which the nozzle is rotatably mounted to the container and is rotatable between an open liquid dispensing position and a closed position.

It is an object of the invention, therefore, to provide a novel and unique low flow rate dispensing apparatus.

A further object of the invention is to provide a liquid dispensing apparatus which dispenses the liquid at a low and generally constant flow rate that is independent of the liquid level within the dispensing container.

It is still a further object of the present invention to provide a liquid dispensing apparatus in which the liquid dispensing nozzle is a flip-top nozzle which is rotatable from an open liquid dispensing position to a closed position in which the nozzle is covered and protected from the environment.

Yet another object of the present invention is to provide a low and generally constant flow rate liquid dispensing apparatus that is relatively inexpensive to manufacture, reliable in its operation over a range of temperatures, and easy to use without the need for auxiliary or external controls.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
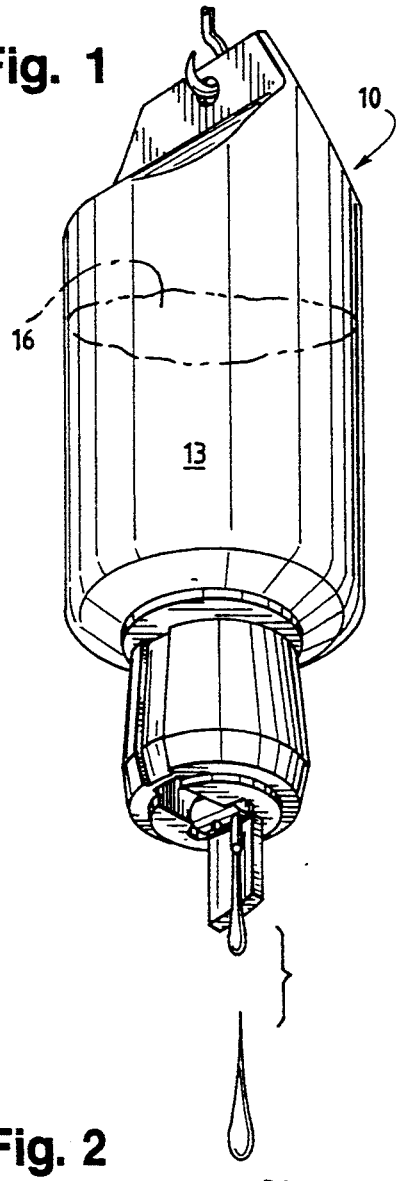
FIG. 1 is a perspective view of the liquid dispensing apparatus of the present invention, showing the liquid dispensing nozzle in the open position and dispensing discrete droplets of liquid.

With reference now to FIG. 1, the liquid dispensing apparatus of the present invention is illustrated and designated generally as 10. The dispensing apparatus 10 includes a container 12 and a liquid dispensing nozzle 14. The container 12 may be of any size, shape or configuration suitable to act as a reservoir for the liquid 13 to be dispensed. The nozzle 14, although shown in FIG. 1 as a part of container cap, may also be constructed as an integral part of the container itself, or even as a separate component designed for assembly to the container.

In order to function in accordance with the present invention, the dispensing nozzle 14 is positioned on container 12 below the liquid level 16, and as illustrated in FIG. 1, the nozzle 14 includes a liquid discharge conduit 20 and an air intake passageway 22. When properly positioned to dispense the liquid 14, and with the nozzle in the open liquid dispensing position, the lower-most end of discharge conduit 20 is positioned below the upper-most end of the air intake passageway 22.

Figure 3:
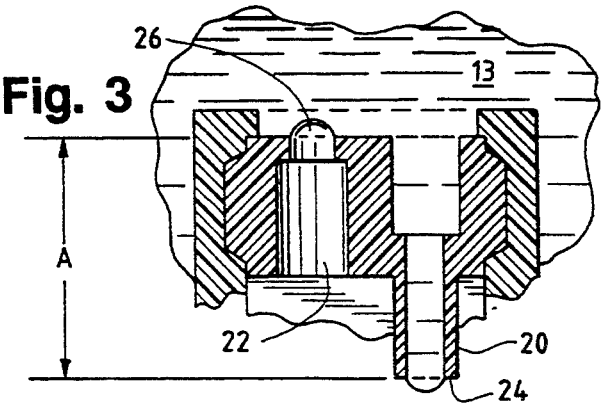
FIG. 3 is a partial, cross-sectional view showing details of the liquid dispensing nozzle at a point in time when an individual liquid droplet is beginning to form.
Figure 4:
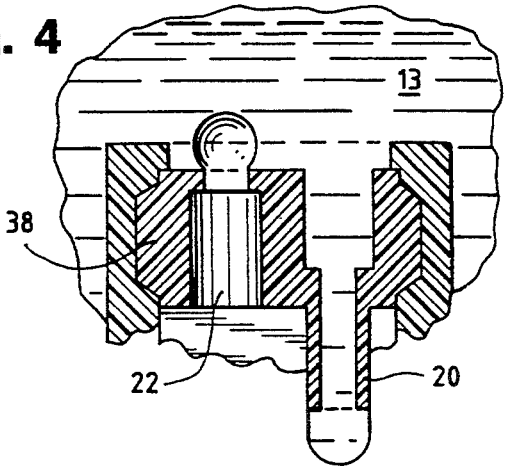
FIG. 4 is a cross-sectional view similar to that of FIG. 3 at a further point in time showing further formation or development of the liquid droplet.
Figure 5:
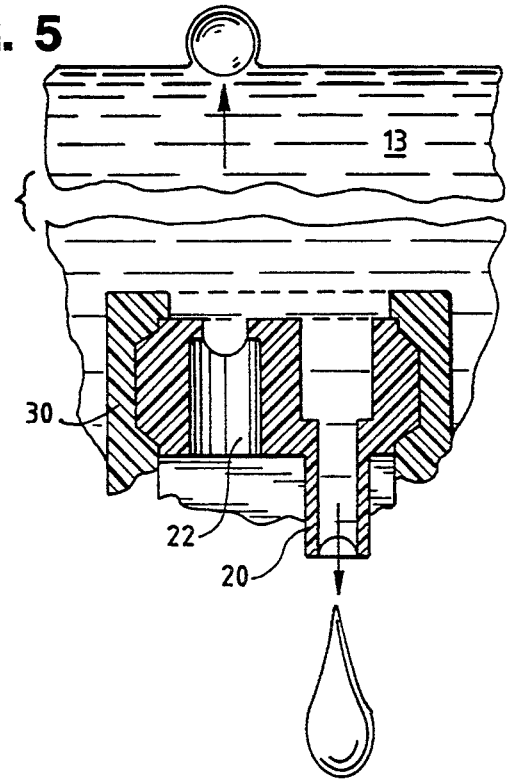
FIG. 5 is a cross-sectional view again similar to those of FIGS. 3 and 4 illustrating at a still further point in time the complete formation and separation of the individual droplet from the liquid dispensing nozzle.

With reference now to FIGS. 2 through 5, further details of the construction and operation of the liquid dispensing nozzle will be described. The liquid discharge conduit 20 terminates at its lower-most end in a liquid discharge port 24, whereas the air intake passageway 22 terminates at its upper-most end in an air intake port 26. Each of these ports is in fluid communication with the liquid held within container 12, and because of their relative position, a differential head, represented by the arrow A in FIG. 3, is established. As a consequence of this differential head, forces are generated at the interface of each of the ports 24 and 26 acting against the surface tension of the liquid exposed at each of these ports. The forces, in turn, tend to move the liquid at the interface of each port in opposite directions. Thus, the liquid interface present at liquid discharge port 24 begins to bulge or protrude downward from port 24, whereas the liquid surface at air intake port 26 tends to move or extend upward. This phenomenon is illustrated clearly in FIG. 3. Moreover, this same phenomenon gradually increases the differential head, thereby increasing gradually the forces acting against the surface tension of the liquid. This, in turn, will accelerate the growth of the droplet forming at the liquid discharge port 24 and the growth of the bubble forming at air intake port 26. This is illustrated in FIG. 4. Finally, the forces generated by the differential head increased to the point where a discrete droplet breaks or separates from the liquid discharge port and a discrete air bubble separates from the air intake port and rises to the surface of the liquid level inside the container. This phenomenon is illustrated in FIG. 5. Having completed the generation and separation of a discrete droplet, the cycle begins once again and, in this manner, the apparatus of the present invention is able to dispense the liquid 14 from container 12 at a very low flow rate.

The apparatus of the present invention is also able to dispense the liquid as described above at a generally constant flow rate which is independent of the liquid level within the container. The specific flow rate that will be achieved is dependent upon a variety of different parameters which include: the diameter of the air intake port 26, the inside diameter of the liquid discharge port 24, the outside diameter of the liquid discharge conduit 20, the vertical height differential between the air intake port 26 and liquid discharge port 24, and the density, viscosity, and surface tension of the liquid to be dispensed.

By way of example, the apparatus of the present invention has been designed to dispense a liquid deer attractant which is composed primarily of glycerine and minor amounts of deer scent liquid from a 5-ounce bottle which is intended to dispense the deer attractant gradually and uniformly over an approximate 3-week period. This requires a drip dispensing rate of approximately 0.3 milliliters per hour, or six drops per hour based on a standard 20 drops per milliliter. Dispensing rates of this magnitude shall be referred to herein as "microflow" dispensing rates. For this dispensing rate, the following dimensions were used in the apparatus of the present invention:

(a) Air intake port diameter—0.059 inches
(b) Inside diameter of liquid-dispensing port—0.045 inches.
(c) Outside diameter of liquid dispensing conduit—0.094 inches.
(d) Differential head—0.50 inches.

The glycerine used in this liquid deer attractant is a pharmaceutical grade which is 96.5% pure, having a specific gravity of 1.26 at 20° C., a kinematic viscosity of 711 ($10^{-5}$) feet$^2$/second.

Of course, those of skill in the art will understand that for different liquids and different flow rates, the various dimensions will necessarily be modified. For example, smaller diameters for the air intake and liquid discharge ports will decrease flow rates, whereas a larger outside diameter for the liquid discharge conduit and a larger vertical differential head will increase flow rates.

Figure 2:
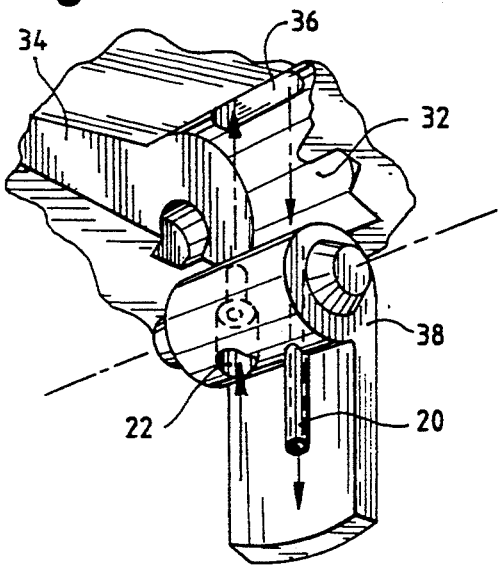
FIG. 2 is an enlarged, exploded, perspective view of a preferred embodiment of the liquid dispensing nozzle constructed in accordance with the present invention.

In accordance with a preferred embodiment of the present invention and as illustrated most clearly in FIGS. 1 and 2, the liquid dispensing nozzle 14 is a flip-top nozzle which is rotatable between an open liquid dispensing position and a closed position. In accordance with this preferred embodiment, the nozzle 14 includes a nozzle housing 30 having a generally cylindrical recess portion 32 and an elongated recess portion 34. The housing 30 includes an aperature 36 positioned in the housing wall of the cylindrical recess 32 which permits fluid communication between the liquid within container 14 and the discharge conduit 20 and air intake passageway 22. The nozzle also includes a cylindrical base 38 having a flat or planar cover 40 which extends tangentially from the base 38. Liquid discharge conduit 20 extends from the cylindrical base in the same direction as the cover 40, while the air intake passageway 22 extends through the cylindrical base, all as illustrated in FIG. 2. When the nozzle is rotated to the open liquid dispensing position, both the liquid discharge conduit 20 and air intake passageway 22 align with aperture 36 to permit fluid communication within the container and the nozzle. When rotated to the closed position, the cover 40 and liquid discharge conduit 20 are located or nested at least partially within the elongated the recess 34. In this way, the cover 40 protects the air intake passageway and liquid discharge conduit from the ambient environment.

Those of skill in the art will appreciate that the dispensing mechanism disclosed here is fluidic-controlled, and can be practiced without the need for electrical or mechanical controls such as switches or flappers. This feature of the dispenser of the present invention will be referred to in the claims as "automatic."

It will be appreciated by those skilled in the art that various changes and modifications can be made to the illustrated embodiments without departing from the spirit of the present invention. All such modifications and changes are intended to be covered by the appended claims.

What is claimed is:

1. A microflow liquid dispensing apparatus, comprising:

a container adapted to hold a liquid, thereby defining a liquid level within the container;

a dispensing element positioned on the container below the liquid level when the container is oriented to dispense the liquid, the dispensing element having a liquid discharge conduit and an air intake port:

the liquid discharge conduit terminating at its lowermost end with a liquid discharge port positioned below the air intake port when the container is oriented to dispense the liquid, the air intake and liquid discharge ports being in fluid communication with the liquid in the container;

the vertical distance between the air intake port and the liquid discharge port defining a head which remains substantially constant during dispensing; and the air intake port having a vertical height relative to the head sufficient to provide a predetermined microflow of the liquid.

2. The microflow liquid dispensing apparatus of claim 1 wherein the liquid dispensing element comprises a nozzle which is rotatably mounted to the container and is rotatable between an open, liquid dispensing position and a closed position.

3. The microflow liquid dispensing apparatus of claim 1 wherein the liquid dispensing element comprises a nozzle which is rotatably mounted within a housing forming a part of the container, the housing having a wall with at least one aperture; and wherein the liquid dispensing nozzle is rotatable between an open liquid dispensing position in which the liquid discharge port and the air intake port communicate with the liquid through the aperture, and a closed position in which the liquid discharge port and the air intake port are blocked from the liquid by the wall.

4. The microflow liquid dispensing apparatus of claim 1 wherein the air intake port comprises a narrow proximal portion which communicates with an air intake passageway comprising a wide distal portion.

5. The microflow liquid dispensing apparatus of claim 1, wherein the liquid discharge port and the air intake port have a size and relative position such that the liquid is dispensed from the container as discrete droplets, the droplets forming and separating from the container at a rate that is independent of the liquid level in the container.

6. The microflow liquid dispensing apparatus of claim 5 wherein the rate is relatively constant.

7. The microflow liquid dispensing apparatus of claim 2 wherein the liquid dispensing nozzle further includes a protective cover that overlies the discharge conduit and the intake port when the nozzle is rotated to the closed position.

8. The microflow liquid dispensing apparatus of claim 3 wherein the housing includes a first generally cylindrical recess in which the aperture is located and a second generally elongated recess; and wherein the liquid dispensing nozzle includes a cylindrical base adapted to rotate within the cylindrical recess and a generally planar cover extending tangentially from the base, the intake port extending through said base and the discharge conduit extending from the base, the discharge conduit and the cover nesting at least partially within the elongated recess when the nozzle is in the closed position.

9. The microflow liquid dispensing apparatus of claim 1, wherein dispensing is provided automatically.

10. A microflow liquid dispensing apparatus, comprising:

a container adapted to hold a liquid, thereby defining a liquid level within the container;

a dispensing element positioned on the container below the liquid level when the container is oriented to dispense the liquid, the dispensing element having a liquid discharge port and an air intake port;

the liquid discharge port being positioned below the air intake port when the container is oriented to dispense the liquid, the air intake port and liquid discharge port being in fluid communication with the liquid in the container;

the vertical distance between the air intake port and the liquid discharge port defining a head which remains substantially constant during dispensing; and the air intake port having a vertical height relative to the head sufficient to provide a predetermined microflow of the liquid.

11. A method for providing microflow liquid dispensing, comprising the steps of:

(a) providing a container adapted to hold a liquid, thereby defining a liquid level within the container;

(b) positioning a dispensing element on the container and below the liquid level when the container is oriented to dispense the liquid, the dispensing element having a liquid discharge conduit and an air intake port, the liquid discharge conduit terminating at its lower-most end with a liquid discharge port positioned below the air intake port when the container is oriented to dispense the liquid, the air intake and liquid discharge ports being in fluid communication with the liquid in the container, the vertical distance between the ports defining a head which remains substantially constant during dispensing, and the air intake port having a vertical height relative to the head sufficient to provide a predetermined microflow of the liquid;

(c) positioning the container to permit the forces generated by the head to act against the surface tension of the liquid present at the interface of each of the ports and to move liquid upwardly from the air intake port and downwardly at the liquid discharge port, thereby increasing the head and resultant forces acting against the surface tension of the liquid to form a discrete droplet that separates from the liquid discharge port and a discrete air bubble that separates from the air intake port and rises to the surface of the liquid level inside the container; and (d) maintaining the container in the dispensing position to repeatedly dispense a microflow of the liquid.

12. The method for providing microflow liquid dispensing according to claim 11, and further comprising wherein steps (b) through (d) occur automatically.

* * * * *